US010637187B2

(12) United States Patent
Marchesi et al.

(10) Patent No.: US 10,637,187 B2
(45) Date of Patent: Apr. 28, 2020

(54) ELECTRICAL CONNECTOR WITH COUPLING RING ARRANGEMENT

(71) Applicant: ITT MANUFACTURING ENTERPRISES, LLC, Wilmington, DE (US)

(72) Inventors: Mauro Marchesi, Pero (IT); Franco Crivelli, Pero (IT); Stefano Izzo, Caronno (IT)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 16/326,893

(22) PCT Filed: Sep. 6, 2017

(86) PCT No.: PCT/IB2017/001092
§ 371 (c)(1),
(2) Date: Feb. 20, 2019

(87) PCT Pub. No.: WO2018/051177
PCT Pub. Date: Mar. 22, 2018

(65) Prior Publication Data

US 2019/0207344 A1 Jul. 4, 2019

(30) Foreign Application Priority Data

Sep. 16, 2016 (DE) ..... 10 2016 117 538

(51) Int. Cl.
*H01R 13/625* (2006.01)
*H01R 13/639* (2006.01)
*H01R 13/64* (2006.01)

(52) U.S. Cl.
CPC ..... *H01R 13/625* (2013.01); *H01R 13/639* (2013.01); *H01R 13/64* (2013.01)

(58) Field of Classification Search
CPC ..... H01R 13/625
See application file for complete search history.

(56) References Cited

U.S. PATENT DOCUMENTS 4,445,743 A 5/1984 Bakker
5,662,448 A 9/1997 Alden
7,837,491 B2 * 11/2010 Collin ..... H01R 13/625 439/317

FOREIGN PATENT DOCUMENTS

DE 100 03 924 A 8/2001
EP 1 024 559 A2 8/2000
(Continued)

OTHER PUBLICATIONS

International Search Report and Written Opinion in PCT/IB2017/001092 dated Nov. 7, 2017 in 9 pages.

*Primary Examiner* — Tho D Ta
(74) *Attorney, Agent, or Firm* — Knobbe Martens Olson & Bear LLP

(57) ABSTRACT

The disclosure relates to an electrical connector comprising a plug element with a longitudinal axis, said plug element having a plug housing with a circular cross-section and a coupling ring arrangement mounted rotatably about the longitudinal axis, wherein at least one guide lug which projects radially inward is arranged on the inner circumferential face of the coupling ring arrangement, and a socket element with a longitudinal axis, said socket element having a socket housing with a circular cross-section for accommodating the plug housing, wherein, on the outer circumferential face of the socket housing, at least one spiral-shaped guide groove is disposed for receiving the at least one guide lug of the coupling ring arrangement, and wherein, at the end of the at least one guide groove, an end position for the at least one guide lug of the coupling ring arrangement is disposed.

12 Claims, 5 Drawing Sheets

(56) References Cited

FOREIGN PATENT DOCUMENTS

| | | | |
|---|---|---|---|
| FR | 1 303 545 | A | 9/1962 |
| GB | 2 320 622 | A | 10/1998 |
| WO | WO 2018/051177 | | 3/2018 |

* cited by examiner

ELECTRICAL CONNECTOR WITH COUPLING RING ARRANGEMENT

INCORPORATION BY REFERENCE TO ANY PRIORITY APPLICATIONS

This application is a U.S. National Phase application of PCT Application No. PCT/M2017/001092, filed Sep. 6, 2017 and published as WO 2018/051177, which claims priority to German Application No. 102016117538.2, filed Sep. 16, 2016, the entire contents of each of the above-identified applications is hereby incorporated by reference.

BACKGROUND

Connectors in which the plug element is fastened by a bayonet-like connection to the socket element, are known, for example, from EP 1 024 559 A2.

To connect the plug element to the socket element, the plug element is positioned on the socket element, wherein the plug housing is inserted into the socket element. The socket housing has a plurality of spiral-shaped guide grooves which are distributed over the outer circumference and into which a corresponding number of guide lugs engage when the plug element is inserted, said guide lugs being disposed over the inner circumference of a coupling ring. The guide grooves and the guide lugs form the bayonet-like connection. Rotating the coupling ring around the longitudinal axis of the plug element causes the guide lugs to slide along the oblique guide grooves and the plug element to be pulled against the socket element. To prevent the plug element from becoming unintentionally detached from the socket element, end positions are disposed at the end of the guide grooves in, for example, the form of a recess oriented in the opposite direction to that in which the plug element is inserted in the socket element and into which the guide lugs engage at the end position, i.e., at the end of the rotational movement of the coupling ring. Between the plug element and the socket element, elastic structure which are compressed by the rotary movement of the coupling ring come into effect. The elastic structure comprise, for example, a spring—in particular, a cup spring or a spring washer—or a seal or a sealing ring made of an elastic material, e.g., rubber or plastic. When the end position is reached, the spring forces of the elastic structure press the guide lugs into the end positions and hold them there. In this way, an unintentional unscrewing of the bayonet-like connection between the plug element and the socket element is to be prevented. The reliability and durability of the bayonet-like connection system is essentially determined by the mechanical stability of the connector, on the one hand, and the elasticity of the elastic structure, on the other.

These known connectors with the bayonet-like connecting system between the plug element and the socket element represent, in fact, an improvement over the plug connectors with a simple thread between the plug element and the socket element, but are not able under extreme mechanical loads (for example, vibrations, jolts, and so on) to ensure a stable, long-term connection between the plug element and the socket element, since the elastic structure lose their elastic properties over time.

SUMMARY OF CERTAIN EMBODIMENTS

The present disclosure relates to an electrical connector. The connector can electrical comprise:

a plug element with a longitudinal axis, said plug element having a plug housing with a circular cross-section and a coupling ring arrangement mounted rotatably about the longitudinal axis, wherein at least one guide lug which projects radially inward is arranged on the inner circumferential face of the coupling ring arrangement, and a socket element with a longitudinal axis, said socket element having a socket housing with a circular cross-section for accommodating the plug housing, wherein, on the outer circumferential face of the socket element, at least one spiral-shaped guide groove for receiving the at least one guide lug of the coupling ring arrangement is disposed, and wherein, at the end of the at least one guide groove, an end position for the at least one guide lug of the coupling ring arrangement is disposed.

The present disclosure is based upon the aim of designing and developing an electrical connector of the type mentioned at the outset in such a way that the connection between the plug element and the socket element cannot, of itself, separate unintentionally, even under extreme mechanical loads.

In order to achieve this aim, it is proposed, starting from the electrical connector of the type mentioned at the outset, that the coupling ring arrangement have a first internal coupling ring which is mounted such that it can be rotated around the longitudinal axis of the plug housing, but, in the direction of the longitudinal axis, is not rotatably mounted and has disposed on its internal circumferential face the at least one guide lug which projects radially inward, and have a second external coupling ring which, on the internal coupling ring, is moveably supported and which cannot be rotated about the longitudinal axis of the plug housing, but which can be rotated about its longitudinal axis in the direction of the longitudinal axis between a release position, in which the coupling ring arrangement can be rotated relative to the longitudinal axis of the plug housing, and a latching position, in which a rotation of the coupling ring arrangement relative to the plug housing is blocked, wherein the external coupling ring can be moved into the latching position at least when the at least one guide lug is in the end position.

Some of the most important differences from the prior art are the following features:

by using the anti-rotation pin or slot, the plug housing, when the plug element is positioned on the socket element and the plug housing is inserted in the socket housing, is prevented from rotating about the longitudinal axes of the plug element and socket element, but can be moved in the direction of insertion into the socket housing, the coupling ring arrangement comprises two separate coupling rings which cannot be rotated relative to each other around the longitudinal axes of the plug element and socket element, but, parallel to the longitudinal axes, are moveably guided, and the external coupling ring can be moved between a release position, in which the coupling ring arrangement can be rotated relative to the plug housing about the plug housing's longitudinal axis, and a latching position, in which a rotation of the coupling ring arrangement relative to the plug housing is blocked.

To fit the electrical connector, the plug element is placed on the socket element, and the plug housing inserted into the socket housing. Here, the socket housing is guided non-rotatably about the longitudinal axes of the plug element and socket element, but, in the insertion direction, moveably at the socket housing.

In addition, the at least one guide lug disposed on the outer guide ring here enters the corresponding at least one guide groove which is disposed on the outer circumferential face of the socket housing. The external coupling ring is rotated about the longitudinal axis relative to the socket housing and, since the plug housing is guided non-rotatably at the socket housing, also relative to the plug housing. Here, the guide lug slides along an inclined ramp formed by the guide groove until it reaches the end area of the guide groove and slides into the end position. Here, the plug element is pulled against the socket element, and the elastic structure of the connector are compressed. Once the end position has been reached, the elastic structure press the guide lug into the end position of the guide groove and hold it in there. At the same time, the external coupling ring is brought into the latching position so that a rotation of the coupling ring arrangement around the longitudinal axes of the plug housing and of the socket housing relative to the plug housing, and also, since the socket housing is guided non-rotatably at the plug housing, relative to the socket housing, is blocked. As long as the external coupling ring is held in the latching position, an inadvertent release of the bayonet-like connection between the plug element and the socket element is effectively prevented.

Contact elements (contact pins or contact sockets), as well as corresponding sealing or insulating inserts made of an insulating—and, preferably, also elastic—material, can be provided inside the plug housing or the socket housing. When the plug and socket elements are brought together and connected in a bayonet-like manner, the contact elements engage with the corresponding openings of the sealing or insulating inserts.

When the plug housing is inserted into the socket housing in an insertion direction which basically runs parallel to the longitudinal axes, a rotation of the plug housing relative to the socket housing around the longitudinal axes is prevented by the contact elements engaging with the corresponding openings of the sealing or insulating inserts. According to an advantageous development of the disclosure, it is, however, suggested that the connector additionally have anti-rotation pin(s) or slot(s) which permit an insertion of the plug housing into the socket housing in an insertion direction which basically runs parallel to the longitudinal axes of the plug element and of the socket element, but which prevent a rotation of the plug housing relative to the socket housing around the longitudinal axes. The anti-rotation pin or slot serve, in particular, also as coding for making possible a simple mating of the plug element and socket element. In addition, the anti-rotation pin or slot prevent rotational forces from acting on the contact elements.

Accordingly, the internal coupling ring on the outer circumferential face of the plug housing is guided rotatably about the longitudinal axis of the plug housing, but cannot be moved in the direction of the longitudinal axis. The external coupling ring is moveably guided on the outer circumferential face of the internal coupling ring in the direction of the longitudinal axis of the plug housing between the release position and the latching position. The spring element presses the external coupling ring into the latching position. This means that the external coupling ring must be brought out of the latching position and into the release position against the force of the spring element, in order to allow a rotation of the coupling ring arrangement relative to the plug housing and about its longitudinal axis. This is, in particular, required to cancel the blocking of the coupling ring arrangement and to make it possible to undo the bayonet-like connection between the plug element and the socket element.

Of course, it is conceivable for the external coupling ring also to be in a latching position when the plug element is positioned on the socket element, the plug housing thus being inserted into the socket housing.

According to a preferred embodiment of the disclosure, it is proposed that the direction of the movement of the external coupling ring out of the release position and into the latching position be directed opposite to the insertion direction of the plug housing into the socket housing. When the plug element is positioned on the socket element to make the bayonet-like connection, the plug element is held on the outer circumferential face of the external coupling ring, the plug element is positioned on the socket element, and, when this has been done, i.e., the anti-rotation pin(s) or slot(s) have engaged with each other and the at least one guide lug has entered the at least one guide groove, a continuation of the positioning movement in the insertion direction causes the external coupling ring to move from the latching position into the release position, and the coupling ring arrangement can be rotated about the longitudinal axis of the plug housing so that the guide lug slides along the inclined ramp of the guide groove, the plug housing being pulled against the socket housing, and, finally, the guide lug reaches the end position, where it stops. The external coupling ring is then released again and, due to the spring force, again reaches the latching position without further assistance. In this way, the connection between the plug element and the socket element can, as it were, be made with a flick of the wrist.

Advantageously, the at least one guide groove extends only over part of the circumference—preferably, over less than 180° and, most preferably, over less than 120°—on the outer circumferential face of the socket housing. The at least one guide lug opens at its start towards the distal front edge of the socket housing, i.e., opposite to the insertion direction and facing the plug element which is to be fitted, so that the at least one guide lug can be guided into the at least one guide groove when the plug element is positioned on the socket element. At the start of the guide lug, there is preferably a straight section which runs parallel to the insertion direction, and thus preferably also parallel to the longitudinal axis of the socket housing.

This straight section then passes into the oblique, thread-like section of the guide lug, which finally terminates in the end position.

The plug element preferably has at least two—preferably, three—spiral guide grooves on the outer circumferential face of the socket housing, and, on the inner circumferential face of the internal coupling ring, a corresponding number of guide lugs which project radially inward are disposed. Multiple guide grooves are of a uniform design, i.e., they have the same pitch and length. When two guide grooves are provided, their starts or their straight receiving sections are preferably arranged offset by 180° to each other on the circumference. When three guide grooves are provided, their starts or their straight receiving sections are preferably arranged offset by 120° to each other on the circumference. The guide lugs are arranged over the inner circumference of the internal coupling ring corresponding to the positions on the circumferential face of the start of the guide grooves, i.e., two guide lugs preferably offset by 180° to each other and three guide lugs offset by 120° to each other are arranged.

It is especially advantageous when the end position for the at least one guide lug has a recess directed towards the distal end of the socket housing, i.e., opposite to the insertion direction of the plug housing into the socket housing, said recess being in an end area of the at least one guide groove. In other words, at the end of the rotational movement of the coupling ring arrangement and upon reaching the end area of the guide groove, the guide lug, by means of a movement against the insertion direction, enters the recess and remains there. After reaching the end area, the guide lug is moved or pressed automatically into the recess by the compressed elastic structure of the connector.

Another advantageous development of the disclosure proposes that, on the outer circumferential face of the internal coupling ring and on the inner circumferential face of the external coupling ring, guides can be disposed which correspond to each other and are connected operatively to each other, so that the external coupling ring cannot rotate on the internal coupling ring, but can move between the release position and the latching position in the direction of the longitudinal axis. According to this development, the external coupling ring is guided on the internal coupling ring, i.e., it can move longitudinally in the insertion direction. Rotation of the external coupling ring thus always forces the internal coupling ring with the one or more radially inward projecting guide lugs to rotate as well. Rotation of the external coupling ring thus causes the entire coupling ring arrangement to rotate, and the guide lugs slide along the ramps of the guide grooves until end positions are reached (when the bayonet-like connection is being made) or until the straight start sections are reached (when the bayonet-like connection is being undone).

It is particularly preferable when the guide(s) for creating the linear relocatability of the external coupling ring relative to the internal coupling ring comprise at least one slot extending in the direction of the longitudinal axis of the plug housing or of the socket housing and at least one blocking tab which can be moved back and forth in the slot. Here, the at least one slot can be disposed on the outer circumferential face of the internal coupling ring. In this case, the at least one blocking tab on the inner circumferential face of the external coupling ring would be designed to extend radially inward. Alternatively, the at least one slot could also be provided in the inner circumferential face of the external coupling ring. In this case, the at least one blocking tab on the outer circumferential face of the internal coupling ring would be designed to extend radially outward. If multiple guides are provided, it would of course also be conceivable that not only at least one slot, but also at least one blocking tab offset to it be arranged on the outer circumferential face of the internal coupling ring. Accordingly, not only would at least one blocking tab (for engaging with the at least one slot on the outer circumferential face of the internal coupling ring) then be provided on the inner circumferential face of the external coupling ring, but also at least one slot offset to it (for engaging with the at least one blocking tab on the outer circumferential face of the internal coupling ring).

Another preferred embodiment of the disclosure proposes that, on the outer circumferential face of the plug housing, a first guide be provided which corresponds to the guide provided on the outer circumferential face of the internal coupling ring, wherein the first guide is positioned on the outer circumferential face of the plug housing in such a way that, when the plug element is introduced into the socket element and the external coupling ring is rotated in such a way that the at least one guide lug is located in the end position, the first guide provided on the outer circumferential face of the plug housing aligns with the guide provided on the outer circumferential face of the internal coupling ring and the external coupling ring reaches the latching position, and the guide provided on the inner circumferential face of the external coupling ring engages with the guide provided on the outer circumferential faces of the internal coupling ring and of the plug housing, so that a rotation of the coupling ring arrangement relative to the plug housing is blocked.

If, for example, a slot is provided on the outer circumferential face of the internal coupling ring as a guide, the first guide on the outer circumferential face of the plug housing would also take the form of a slot. Accordingly, a blocking tab would be provided on the inner circumferential face of the external coupling ring, said blocking tab being installed in the slot on the outer circumferential face of the internal coupling ring so that it can slide longitudinally. In the release position, the blocking tab is fully accommodated by the slot on the outer circumferential face of the internal coupling ring. The coupling ring arrangement can be freely rotated on the plug housing. In the latching position, the blocking tab is only partially accommodated by the slot on the outer circumferential face of the internal coupling ring. Another part of the blocking tab is accommodated by the slot on the outer circumferential face of the plug housing and acts almost like a latch which blocks a rotational movement of the external coupling ring and thus the entire coupling ring arrangement relative to the plug housing. According to this embodiment, the external coupling ring is brought into the latching position and the coupling ring arrangement blocked when the one or more guide lugs reach the end position(s) of the guide groove(s), since, in this rotational position of the coupling ring arrangement, the slots in the outer circumferential faces of the internal coupling ring and plug housing align with each other, and the blocking tab can engage with both. Of course, it would also be conceivable for a blocking tab to be provided in each case on the outer circumferential faces of the internal coupling ring and plug housing, and, on the inner circumferential face of the external coupling ring, for a slot to be provided which, in the release position, would receive only the blocking tab of the internal coupling ring and, in the latching position, would, in addition, also still receive the blocking tab of the plug housing.

According to yet another preferred embodiment of the disclosure, it is proposed that, on the outer circumferential face of the plug housing, a second guide be provided which corresponds to the guide provided on the outer circumferential face of the internal coupling ring, wherein the second guide is so circumferentially positioned on the outer circumferential face of the plug housing that, when the plug element is inserted in the socket element and the external coupling ring has not yet been rotated, the second guide provided on the outer circumferential face of the plug housing aligns with the guide provided on the outer circumferential face of the internal coupling ring and the external coupling ring reaches the latching position, and the guide provided on the inner circumferential face of the external coupling ring engages with the guide provided on the outer circumferential faces of the internal coupling ring and plug housing, so that a rotation of the coupling ring arrangement relative to the plug housing is blocked. According to this embodiment, the external coupling ring is brought into the latching position and the coupling ring arrangement blocked when the plug element is positioned on the socket element and the one or more guide lugs reach the straight receiving section(s) of the guide groove(s), since, in this rotational position of the coupling ring arrangement, the slots in the outer circumferential faces of the internal coupling ring and plug housing align with each other, and the blocking tab can engage with both. Of course, it would also be conceivable here for a blocking tab to be provided in each case in the outer circumferential faces of the internal coupling ring and plug housing and, on the inner circumferential face of the external coupling ring, for a slot to be provided which, in the release position, would receive only the blocking tab of the internal coupling ring and, in the latching position, would, in addition, also still receive the blocking tab of the plug housing.

Finally, it is proposed that the anti-rotation pin or slot, which prevent a rotation of the plug housing inserted into the socket housing around the longitudinal axes of the plug housing and the socket housing relative to the socket housing, be provided with a securing slot in the plug housing extending in the direction of the longitudinal axis, and a corresponding securing pin be provided on the inner circumferential face of the socket housing, which securing pin enters the securing slot when the plug housing is inserted in the socket housing and prevents the plug housing and the socket housing from rotating about the longitudinal axes of the socket housing and plug housing, but permits movement in the insertion direction.

BRIEF DESCRIPTION OF THE DRAWINGS

Further features and advantages of the present disclosure are explained in more detail below with reference to the figures. These show.

DETAILED DESCRIPTION OF CERTAIN EMBODIMENTS

Figure 1:
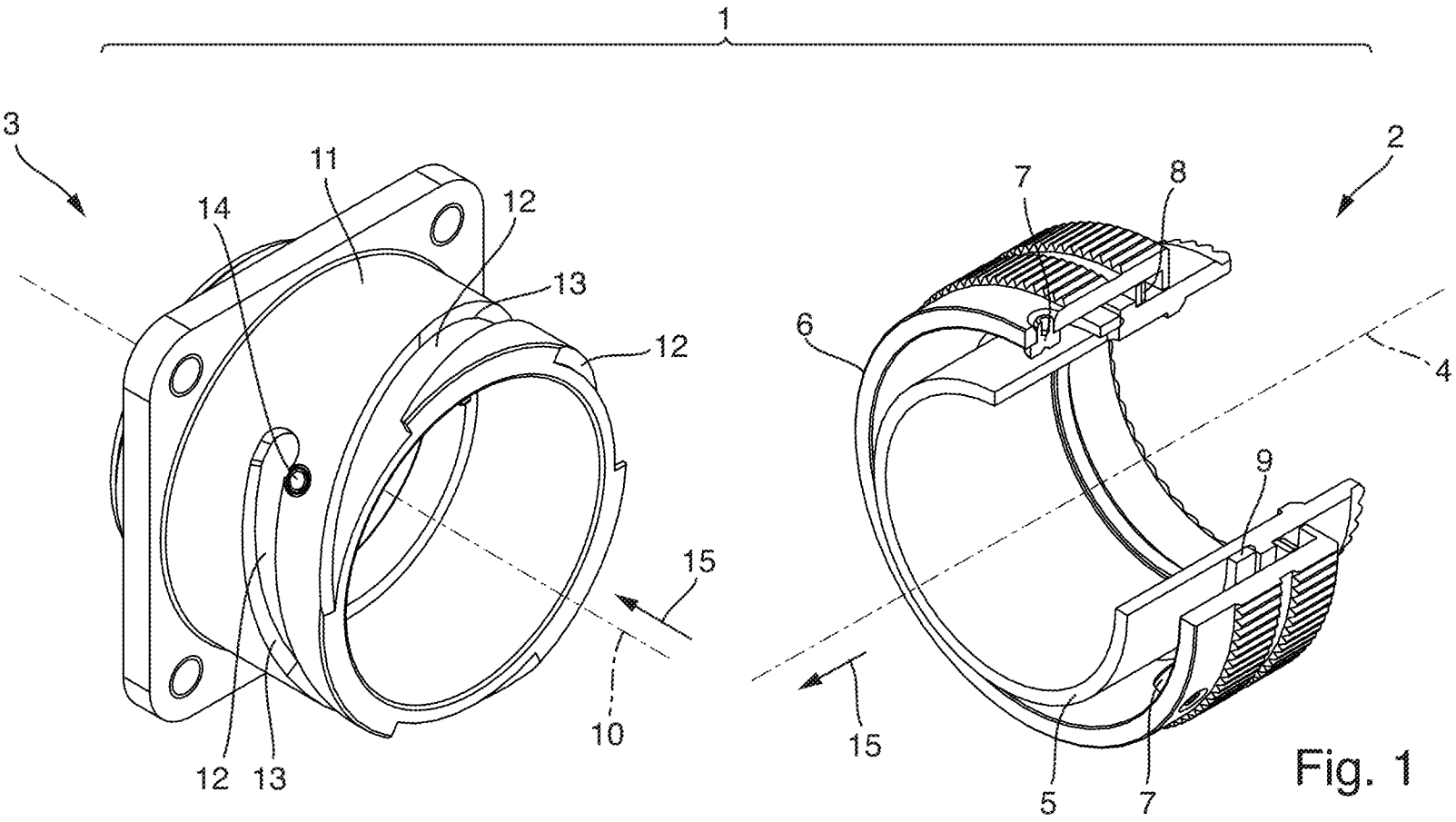
Fig. 1 PRIOR ART
FIG. 1 illustrates an electrical connector known from prior art in a perspectival view, and partly in section.

FIG. 1 shows a connector known from prior art in its entirety, indicated with the reference number 1. The connector comprises a plug element 2 and a socket element 3. The plug element 2 has a longitudinal axis 4 and a plug housing 5 with a circular cross-section. A coupling ring arrangement 6 which is mounted rotatably around the longitudinal axis 4 is arranged on the housing 5. Here, the coupling ring arrangement 6 comprises a single coupling ring. Several radially inward projecting guide lugs 7 are provided on the inner circumferential face of the coupling ring arrangement 6. Between the coupling ring arrangement 6 and the plug housing 5, elastic structure 8 act so that the coupling ring arrangement 6 can only be moved on the plug housing 5 parallel to the longitudinal axis 4 and against the force of the elastic structure 8. The elastic structure 8 comprise, for example, a spring element—in particular, a cup spring or a spring washer—or a seal or a sealing ring made of an elastic material, e.g., rubber or plastic. In addition, a sealing ring 9 made of rubber or plastic can be provided on the outer circumferential face of the plug housing 5.

The socket element 3 has a longitudinal axis 10 and a socket housing 11 with a circular cross-section for receiving the plug housing 5. On the outer circumferential face of the socket housing 11, a plurality of spiral-shaped guide grooves 12 are provided for receiving the guide lugs 7 of the coupling ring arrangement 6. In the example shown here, three guide lugs 7 and also three guide grooves 12 are provided which are offset by 120° to each other. The guide grooves 12 form inclined ramps 13 along which the guide lugs 7 introduced into the guide grooves 12 and guided by rotating the coupling ring arrangement 6 slide. At the end of each guide groove 12, an end position 14 is provided for the guide lugs 7 of the coupling ring arrangement 6.

To connect the plug element 2 to the socket element 3, the plug element 2 is positioned on the socket element 3, wherein the plug housing 5 is inserted into the socket housing 11. When the plug element 2 is placed on the socket element 3, the guide lugs 7 engage the guide grooves 12. The guide grooves 12 and the guide lugs 7 form a bayonet-like connection between the plug element 2 and the socket element 3. Rotating the coupling ring 6 around the longitudinal axis 4 of the plug element 2 causes the guide lugs 7 to slide along the oblique guide grooves 12 and the plug element 2 to be pulled against the socket element 3. The end positions 14 at the end of the guide grooves 12 take the form, for example, of recesses oriented opposite to the direction 15 taken when the plug element 2 is being positioned on or inserted into the socket element 3, said recesses being entered by the guide lugs 7 in the end position, i.e., at the end of the rotational movement of the coupling ring 6. The elastic structure 8 acting between the plug housing 5 and the coupling ring 6 are compressed by the rotational movement of the coupling ring 6. When the end position is reached, the guide lugs 7 are pressed into the end positions 14 by the forces of the elastic structure 8 and held there. This is intended to prevent an unintentional unscrewing of the bayonet-like connection between the plug element 2 and the socket element 3. The reliability and durability of the bayonet-like connection system is essentially determined by the mechanical stability of the connector 1, on the one hand, and the elasticity of the elastic structure 8 on the other.

The present disclosure proposes an electrical connector 1 which, even under extreme mechanical loads (for example, vibrations, jolts, and so on), ensures a stable, long-term connection between the plug element 2 and the socket element 3.

Figure 2:
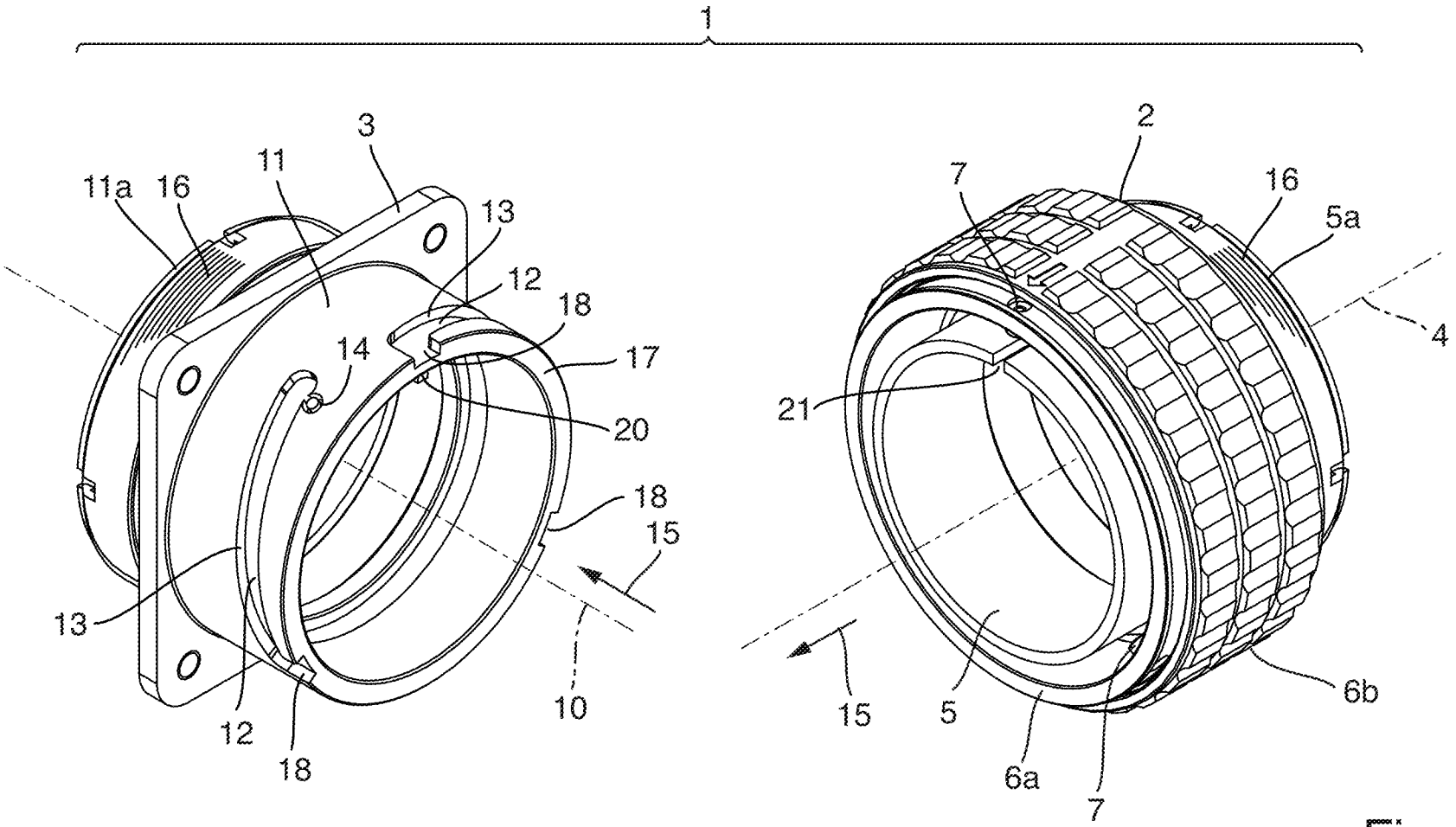
FIG. 2 illustrates an electrical connector according to the disclosed embodiment in a perspectival view.

In this regard, a connector 1 is proposed such as is shown by way of example in FIG. 2. The coupling ring arrangement 6 of the connector 1 has a first internal coupling ring 6*a* which is mounted such that it can be rotated around the longitudinal axis 4 of the plug housing 5, but, in the direction of the longitudinal axis 4, is not rotatably mounted and has, on its internal circumferential face, the at least one guide lug 7 which projects radially inward. In the example shown here, three guide lugs 7 are arranged which are offset by 120° to each other. In addition, the coupling ring arrangement 6 has a second external coupling ring 6*b* which is moveably supported and which cannot be rotated on the internal coupling ring 6*a* about the longitudinal axis 4 of the plug housing 5, but, in the direction of the longitudinal axis 4, can be rotated between a release position, in which the coupling ring arrangement 6 can be rotated relative to the longitudinal axis 4 of the plug housing 5, and a latching position, in which a rotation of the coupling ring arrangement 6 relative to the plug housing 5 is blocked. The external coupling ring 6*b* can then at least be moved into the latching position when the guide lugs 7 are in the end position 14.

Some of the most important differences between the connector 1 and the prior art are therefore to be found in the following features in particular:

through the anti-rotation pin(s) or slot(s) 20, 21, the plug housing 5, when the plug element 2 is positioned on the socket element 3 and the plug housing 5 is inserted in the socket housing 11, is prevented from rotating about the longitudinal axes 4, 10 of the plug element 2 or socket element 3, but can moved in the direction of insertion 15 into the socket housing 11, the coupling ring arrangement 6 comprises two separate coupling rings 6*a*, 6*b* which cannot be rotated relative to each other around the longitudinal axes 4, 10 of the plug element 2 or socket element 3, but are moveably guided parallel to the longitudinal axes 4, 10, and the external coupling ring 6*b* can be moved between a release position, in which the coupling ring arrangement 6 can be rotated relative to the plug housing 5 about its longitudinal axis 4, and a latching position, in which a rotation of the coupling ring arrangement 6 relative to the plug housing 5 is blocked.

It is conceivable for the connector 1 to have anti-rotation pin(s) or slot(s) 20, 21, which permit an insertion of the plug housing 2 into the socket housing 3 in the insertion direction 15, which basically runs parallel to the longitudinal axes 4, 10 of the plug element 2 or socket element 3, but which prevent a rotation of the plug housing 5 relative to the socket housing 11 around the longitudinal axes 4, 10. In addition, these pin(s) or slot(s) 20, 21 prevent rotational forces from acting on the contact elements (see reference number 29 in FIG. 6) of the connector 1.

The connector 1 has an additional securing device to effectively prevent an inadvertent undoing of the bayonet-like connection between the plug element 2 and the socket element 3, even under extremely strong mechanical loads. The only way to undo the connection without damaging the connector 1 is to move the external coupling ring 6*b* out of the latching position and into the release position. The anti-rotation pin(s) or slot(s) 20, 21, which prevent a rotation of the plug housing 5 inserted into the socket housing 11 around the longitudinal axes 4, 10 of the plug housing 5 and the socket housing 11 relative to the socket housing 11, are provided, for example, with a securing slot 21 in the plug housing 5 extending in the direction of the longitudinal axis 4, and a corresponding securing pin 20 is provided on the inner circumferential face of the socket housing 11, which securing pin 20 enters the securing slot 21 when the plug housing 5 is inserted in the socket housing 11 and prevents the socket housing 11 from rotating about the longitudinal axes 4, 10 of the plug housing 5 and socket housing 11, but ensures movement in the insertion direction 15.

To fit the electrical connector 1, the plug element 2 is placed on the socket element 3 and the plug housing 5 inserted into the socket housing 11. Here, the plug housing 5 is guided by the anti-rotation pin(s) or slot(s) 20, 21 so that it is prevented from rotating about the longitudinal axes 4, 10 of the plug element 2 or socket element 3, but can move in the direction of insertion 15 into the socket housing 11. In addition, the guide lugs 7 disposed on the outer guide ring 6*b* here enter the corresponding guide grooves 12 on the outer face of the socket housing 11. The external coupling ring 6*b* is rotated about the longitudinal axis 4 relative to the socket housing 11 and—since the plug housing 5 is guided via the anti-rotation pin(s) or slot(s) 20, 21 non-rotatably at the socket housing 11—also relative to the plug housing 5. Here, the guide lugs slide along inclined ramps 13 formed by the guide grooves 12 until they reach the end area of the corresponding guide groove 12 and slide into the end position 14. Here, the plug element 2 is pulled against the socket element 3, and the elastic structure 8 of the connector 1 are compressed. Once the end sections of the guide grooves 12 have been reached, the elastic structure 8 press the guide lugs 7 into the end positions 14 of the guide groove and hold them in there. This is a first measure for securing the coupling ring arrangement 6 in the end position. At the same time, the external coupling ring 6*b* is brought into the latching position by a movement opposite to the insertion direction 15 relative to the internal coupling ring 6*a*, so that rotation of the coupling ring arrangement 6 around the longitudinal axes 4, 10 relative to the plug housing 5 and also, since the socket housing 11 is guided non-rotatably at the plug housing 5, relative to the socket housing 11, is blocked. This represents an additional measure for securing the coupling ring arrangement 6 in the end position. As long as the external coupling ring 6*b* is held in the latching position, an inadvertent release of the bayonet-like connection between the plug element 2 and the socket element 3 is effectively prevented.

At the rearward ends 5*a*, 11*a* of the plug housing 5 or socket housing 11, a threaded hole 16 can be provided for fastening additional accessories. It would also be conceivable to give the rearward ends 5*a*, 11*a* any other form than that shown here, and/or to there provide any other elements.

Figure 3B:
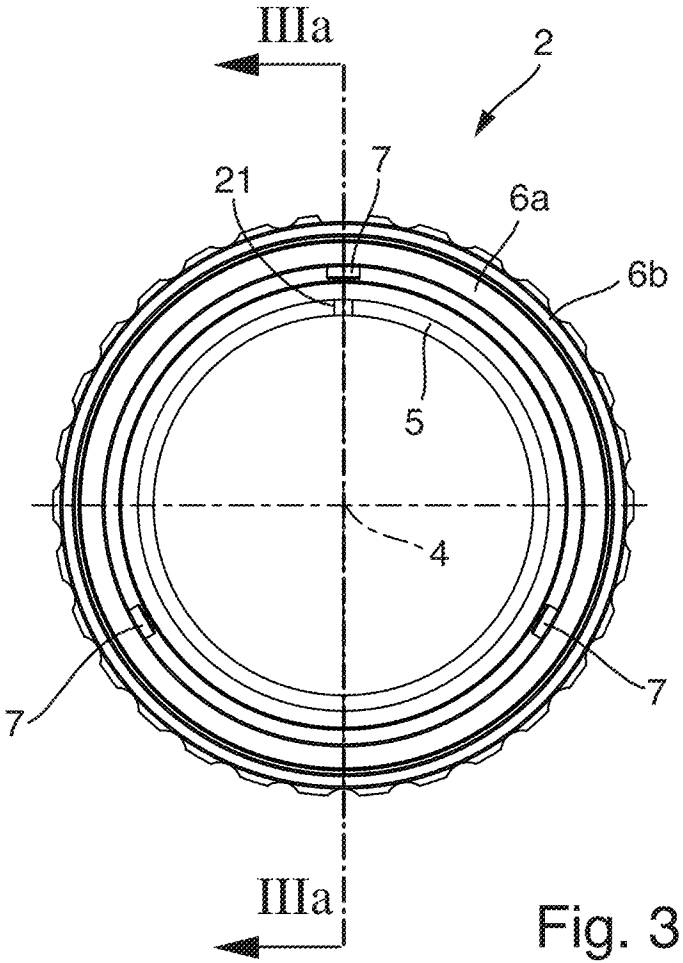
FIG. 3*b* illustrates the plug element of the electrical connector according to the disclosed embodiment shown in FIG. 2 in a top view against an insertion direction.
Figure 3A:
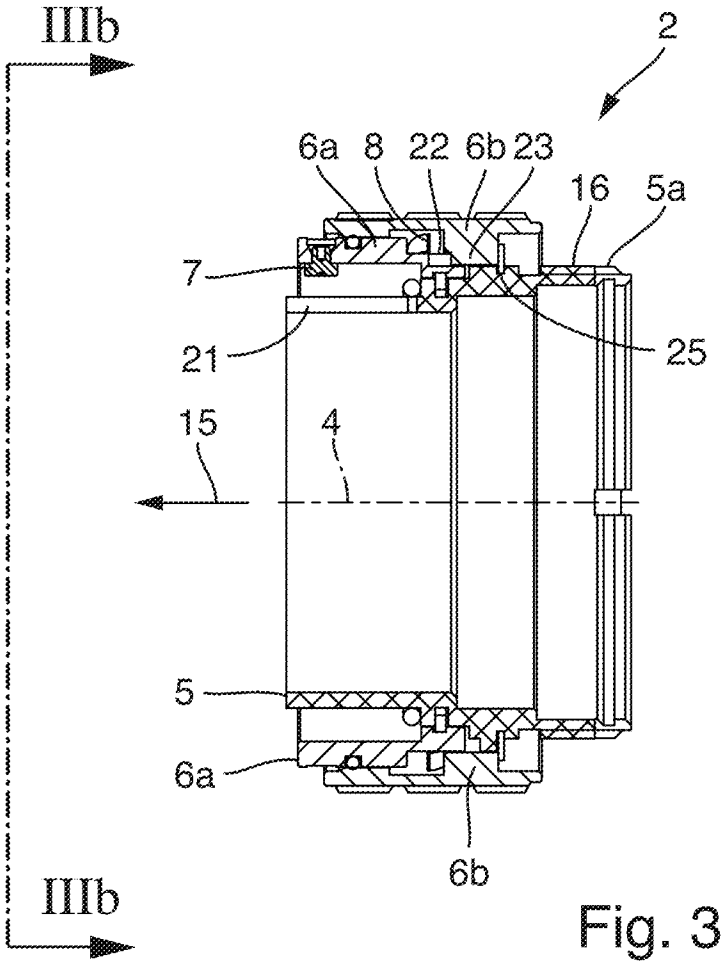
FIG. 3*a* illustrates a plug element of the electrical connector according to the disclosed embodiment shown in FIG. 2 in a longitudinal section.

The spring element 8 (cf. FIG. 3*a*), which acts to press the external coupling ring 6*b* into the latching position, is arranged between the coupling rings 6*a*, 6*b*. The internal coupling ring 6*a* is guided rotatably on the outer circumferential face of the plug housing 5 about the longitudinal axis 4, but cannot be moved in the direction of the longitudinal axis 4. The external coupling ring 6*b* is moveably guided on the outer circumferential face of the internal coupling ring 6*a* in the direction of the longitudinal axis 4 of the plug housing 5 between the release position and the latching position. The spring element 8 pushes the external coupling ring 6*b* into the latching position. This means that the external coupling ring 6*b* must be brought out of the latching position and into the release position in opposition to the force of the spring element 8, in order to allow a rotation of the coupling ring arrangement 6 relative to the plug housing 5 and about its longitudinal axis 4. This is, in particular, required to cancel the blocking of the coupling ring arrangement 6 and to make it possible to undo the bayonet-like connection between the plug element 2 and the socket element 3.

Of course, it is conceivable for the external coupling ring 6*b* to also be in a latching position or able to be brought into such when the plug element 2 is positioned on the socket element 3 and the plug housing 5 thus inserted into the socket housing 11.

The direction of the movement of the external coupling ring 6*b* out of the release position and into the latching position is directed opposite to the insertion direction 15 of the plug housing 5 into the socket housing 11. To make the bayonet-like connection, the plug element 2 is held on the outer circumferential face of the external coupling ring 6*b*, the plug element 2 is positioned on the socket element 3, and, when this has been done, i.e., the anti-rotation pin(s) or slot(s) 20, 21 have engaged with each other and the guide lugs 7 have entered the guide grooves 12, a continuation of the positioning movement in the insertion direction 15 causes the external coupling ring 6*b* to move from the latching position into the release position, and the coupling ring arrangement 6 can be rotated about the longitudinal axis 4 of the plug housing 5 so that the guide lugs 7 slide along the inclined ramps 13 of the guide grooves 12, the plug housing 5 being pulled against the socket housing 11, and, finally, the guide lugs 7 reach the end positions 15, where they stop. The external coupling ring 6*b* is then released again and, due to the spring force of the spring element 8, reaches the latching position again without further assistance. In this way, the connection between the plug element 2 and the socket element 3 can, as it were, be made with a flick of the wrist ("one-touch").

The guide grooves 12 extend over only part of the circumference—preferably, over less than 180° and, most preferably, over less than 120°—on the outer circumferential face of the socket housing 11. The guide lugs 12 open at their start towards the distal front edge 17 of the socket housing 11, i.e., opposite to the insertion direction 15 and facing the plug element 2 which is to be fitted, so that the guide lugs 7 can be guided into the guide grooves 12 when the plug element 2 is positioned on the socket element 3. At the start of the guide grooves 12, these have in each case a straight section 18 which runs parallel to the insertion direction 15 and thus, preferably, also parallel to the longitudinal axis 10 of the socket housing 11. This straight section 18 then passes into the oblique, thread-like section of the guide groove 12 which finally terminates in the end position 14.

The connector 1 has at least two—preferably, three—spiral guide grooves 12 on the outer circumferential face of the socket housing 11. Accordingly, a corresponding number of guide lugs 7 which project radially inward are disposed on the inner circumferential face of the internal coupling ring 6*a*. All guide grooves 12 are of a uniform design, i.e., they have the same pitch and length.

The end positions 14 for the guide lugs 7 have recesses in the end area of the guide grooves 12, said recesses being directed towards the distal end 17 end of the socket housing 3, opposite to the insertion direction 15 of the plug housing 5 into the socket housing 11. In other words, at the end of the rotational movement of the coupling ring arrangement 6, and upon reaching the end area of the guide grooves 12, the guide lugs 7, by means of a movement against the insertion direction 15, enter the recesses and remain there. After reaching the end area, the guide lugs 7 are moved or pressed automatically into the recesses 14 by the effect of the compressed elastic structure 8 of the connector 1.

On the outer circumferential face of the internal coupling ring 6*a* and on the inner circumferential face of the external coupling ring 6*b*, guides are disposed which correspond to each other and are connected operatively to each other, so that the external coupling ring 6*b* cannot rotate on the internal coupling ring 6*a*, but can move between the release position and the latching position in the direction of the longitudinal axis 4. The external coupling ring 6*b* is therefore guided so that it can be moved longitudinally in the insertion direction 15, but cannot be rotated on the internal coupling ring 6*a*. Rotation of the external coupling ring 6*b* thus always forces the internal coupling ring 6*a* with the one or more radially inward projecting guide lugs 7 to rotate as well. Rotation of the external coupling ring 6*b* thus causes the entire coupling ring arrangement 6 to rotate, and the guide lugs 7 slide along the ramps 13 of the guide grooves 12 until the end positions 14 are reached (when the bayonet-like connection is being made) or until the straight start sections 18 are reached (when the bayonet-like connection is being undone).

The guides for creating the linear relocatability of the external coupling ring 6*b* relative to the internal coupling ring 6*a* comprise, for example, at least one slot 22, extending in the direction of the longitudinal axis of the plug housing or of the socket housing, and at least one blocking tab 23, which can be moved back and forth in the slot 22. In the example shown here, three slots 22 are distributed over the outer circumference of the internal coupling ring 6*a*. Accordingly, three blocking tabs 23 are provided, which are distributed over the inner circumferential face of the external coupling ring 6*b* and which extend radially inward.

Alternatively, the at least one slot could also be provided in the inner circumferential face of the external coupling ring 6*b*. In this case, the at least one blocking tab on the outer circumferential face of the internal coupling ring 6*a* would be designed to extend radially outward. Of course, it would also be conceivable for not only at least one slot, but also at least one blocking tab offset to it to be arranged on the outer circumferential face of the internal coupling ring 6*a*. Accordingly, not only would at least one blocking tab (for engaging with the at least one slot on the outer circumferential face of the internal coupling ring) then be provided on the inner circumferential face of the external coupling ring 6*b*, but also at least one slot offset to it (for engaging with the at least one blocking tab on the outer circumferential face of the internal coupling ring).

On the outer circumferential face of the plug housing 5 (see FIG. 4), a second guide 24 is provided which corresponds to the first guide 22 provided on the outer circumferential face of the internal coupling ring 6*a*. In the example shown here, with the slots 22 distributed over the outer circumferential face of the internal coupling ring 6*a*, the second guide 24 also include at least one slot. The second guide is positioned circumferentially on the outer circumferential face of the plug housing 5 in such a way that, when the plug element 2 is introduced into the socket element 3 and the external coupling ring 6*b* is rotated in such a way that the at least one guide lug 7 is located in the end position 14, the second guide 24 provided on the outer circumferential face of the plug housing 5 aligns with the first guide 22 provided on the outer circumferential face of the external coupling ring 6*b* and the external coupling ring 6*b* reaches the latching position, and the third guide 23 provided on the inner circumferential face of the external coupling ring 6*b* engages with the first and second guides 22, 24 provided on the outer circumferential faces of the internal coupling ring 6*a* and of the plug housing 5, so that a rotation of the coupling ring arrangement 6 relative to the plug housing 5 is blocked.

If, for example, a slot 22 is provided on the outer circumferential face of the internal coupling ring 6*a* as a guide, the second guide 24 on the outer circumferential face of the plug housing 5 would also take the form of a slot. Accordingly, a blocking tab 23 would be provided on the inner circumferential face of the external coupling ring 6*b*, said blocking tab 23 being installed in the slot 22 on the outer circumferential face of the internal coupling ring 6*a* so that it can slide longitudinally. In the release position, the blocking tab 23 is fully accommodated by the slot 22 on the outer circumferential face of the internal coupling ring 6*a*. The coupling ring arrangement 6 can be freely rotated on the plug housing 5. In the latching position, the blocking tab 23 is only partially accommodated by the slot 22 on the outer circumferential face of the internal coupling ring 6*a*. Another part of the blocking tab 23 is accommodated by the slot 24 on the outer circumferential face of the plug housing 5 and acts almost like a latch, which blocks a rotational movement of the external coupling ring 6*b*, and thus of the entire coupling ring arrangement 6 relative to the plug housing 5. According to this embodiment, the external coupling ring 6*b* is brought into the latching position and the coupling ring arrangement 6 blocked when the guide lugs 7 reach the end positions 14 of the guide grooves 12, since, in this rotational position of the coupling ring arrangement 6, the slots 22, 24 in the outer circumferential faces of the internal coupling ring 6*a* and plug housing 5 align with each other, and the blocking tab 23 can engage with both. Of course, it would also be conceivable in an alternative embodiment for a blocking tab to be provided in each case in the outer circumferential faces of the internal coupling ring 6*a* and plug housing 5, and, on the inner circumferential face of the external coupling ring 6*b*, for a slot to be provided which, in the release position, would receive only the blocking tab of the internal coupling ring 6*a* and, in the latching position, would, in addition, also still receive the blocking tab of the plug housing 5.

Furthermore, it is conceivable that, on the outer circumferential face of the plug housing 5, a fourth guide 25 be provided which corresponds to the first guide 22 provided on the outer circumferential face of the internal coupling ring 6*a*, wherein the fourth guide 25 is so circumferentially positioned on the outer circumferential face of the plug housing 5 that, when the plug element 2 is inserted in the socket element 3 and the external coupling ring 6*b* has not yet been rotated, the fourth guide 25 provided on the outer circumferential face of the plug housing 5 aligns with the first guide 22 provided on the outer circumferential face of the internal coupling ring 6*a* and the external coupling ring 6*b* reaches the latching position, and the third guide 23 provided on the inner circumferential face of the external coupling ring 6*a* engages with the first guide and fourth guide 22, 25 provided on the outer circumferential faces of the internal coupling ring 6*a* and plug housing 5, so that a rotation of the coupling ring arrangement 6 relative to the plug housing 5 is blocked. Preferably, the fourth guide 25 are offset by a certain angle relative to the first guide 24 on the outer circumferential face of the plug housing 5.

According to this embodiment, the external coupling ring 6*b* is brought into the latching position and the coupling ring arrangement 6 blocked when the plug element 2 is positioned on the socket element 3 and the guide lugs 7 reach the straight receiving section 18 of the guide grooves 12, since, in this rotational position of the coupling ring arrangement 6, the slots 22, 25 in the outer circumferential faces of the internal coupling ring 6*a* and of plug housing 5 align with each other, and the blocking tab 23 can engage with both. Of course, it would also be conceivable here for a blocking tab to be provided in each case on the outer circumferential faces of the internal coupling ring 6*a* and of the plug housing 5 and, on the inner circumferential face of the external coupling ring 6*b*, for a slot to be provided which, in the release position, would receive only the blocking tab of the internal coupling 6*a* and, in the latching position, would, in addition, also still receive the blocking tab of the plug housing 5.

In summary, the external coupling ring 6*b* is positioned above the internal coupling ring 6*a* in the starting situation, before the bayonet-like connection between the plug element 2 and the socket element 3 is made. The spring element 8, which pushes the external coupling ring 6*b* in the opposite direction to the insertion direction 15 and into the latching position, acts between the two coupling rings 6*a*, 6*b*. In the latching position, three blocking tabs 23 provided on the inner circumferential face of the external coupling ring 6*b* engage, not only with the slots 22 on the internal coupling ring 6*a*, but also with the at least one second slot 25 on the outer circumferential face of the plug housing 5. In this state, a rotation of the coupling rings 6*a*, 6*b* relative to the plug housing 5 is blocked, and one of the guide lugs 7 on the inner circumferential face of the external coupling ring 6*b* (in FIG. 3*b*, the upper guide lug 7) is brought into line with the securing slot 21.

Figure 4:
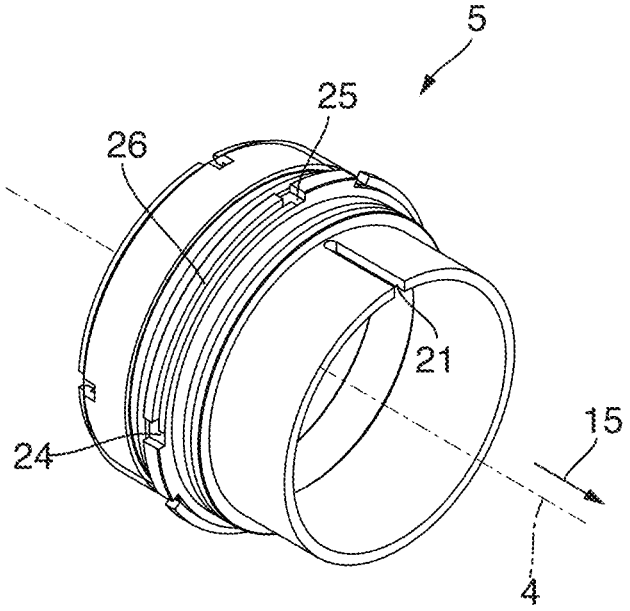
FIG. 4 illustrates a plug housing of the plug element shown in FIGS. 3*a* and 3*b* in a perspectival view.

In FIG. 4, an outer circumferential face of the plug housing 5 is shown by way of example with the elements which implement a blocking or a free rotation of the external coupling ring 6*b*, and thus of the entire coupling ring arrangement 6 relative to the plug housing 5. The circumferential face comprises:

a second slot 25 into which one of the blocking tabs 23 engages when the connector 1 is in an uncoupled state and the spring element 8 presses the external coupling ring 6*b* backwards into the latching position, a first slot 24 into which one of the blocking tabs 23 engages when the connector 1 is in a coupled state and the spring element 8 presses the external coupling ring 6*b* backwards into the latching position, a curved element 26 along which the blocking tabs 23 can slide when the external coupling ring 6*b* is pressed manually against the force of the spring element 8 forward into the release position and can rotate freely on the plug housing 5 while the bayonet-like connection is being made.

Figure 5:
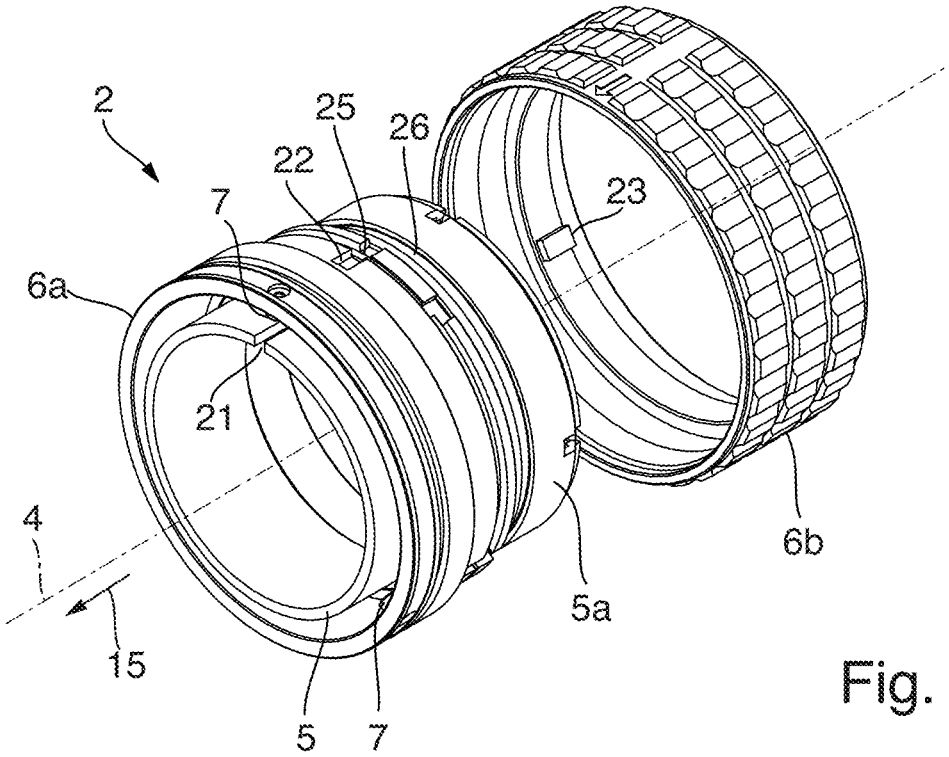
FIG. 5 illustrates the plug element of the electrical connector according to the disclosed embodiment shown in FIG. 2 in an exploded view.

In FIG. 5, the plug element 2 is shown again in an exploded view. The plug housing 5, the internal coupling ring 6*a* which is mounted rotatably on it, and the external coupling ring 6*b* which has been removed are shown clearly. To position the plug element 2 on the socket element 3 and to fasten it to the said socket element 3, it is necessary to undo the blocking of the rotation of the coupling ring arrangement 6 by sliding the external coupling ring 6*b* longitudinally in the insertion direction 15 out of the latching position and into the release position, so that the blocking tabs 23 leave the slot 25 on the outer circumferential face of the plug housing 5 and are only still held in the slot 22 on the outer circumferential face of the external coupling ring 6*a*. In this way, the rotation of both coupling rings 6*a*, 6*b* around the longitudinal axis 4 is made possible, wherein the rotation is defined and determined by the form or course of the curved element 26 which is provided on the outer circumferential face of the plug housing 5. The angle of the rotation derives from the length of the spiral guide grooves 12 which are provided on the outer circumferential face of the socket housing 11.

Once the connector 1 or the plug element 2 is fully mounted on the socket element 3, the rotation of the coupling rings 6*a*, 6*b* is ended, and the blocking tabs 23 of the external coupling ring 6*b* are aligned with the slots 24 (not shown in FIG. 5) on the outer circumferential face of the plug housing 5. In this end position, the spring element 8 (not shown in FIG. 5) pushes the external coupling ring 6*b* back (in a direction opposite the insertion direction 15) into the latching position, and the blocking tabs 23 engage with the slot 24. The coupling ring arrangement 6 is thus in its end position, and the plug element 2 and the socket element 3 are thus mechanically secured in their coupled state, with no possibility of this coupled state coming apart accidentally or unintentionally. To undo the securing and coupling of plug element 2 and socket element 3, the steps described should be taken in reverse order.

Figure 6:
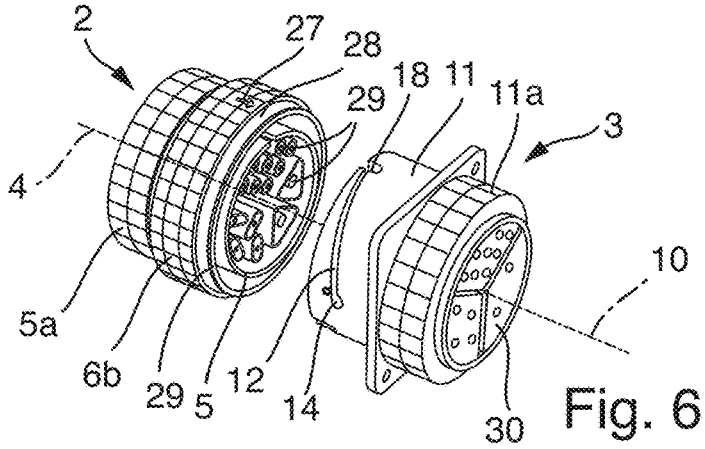
FIGS. 6 through 9 illustrates the various steps in making a bayonet-like connection between the plug element and the socket element of the connector according to the disclosure.

The operation of coupling the plug element 2 and the socket element 3 is explained in more detail with the aid of FIGS. 6 through 9. In FIG. 6, it can be seen that the external coupling ring 6*b* is brought into a rotational position with respect to the plug housing 5, in which an arrow 27 provided on the outer circumferential face of the external coupling ring 6*b* is in a position above the securing slot 21. In this rotational position, the spring element 8 pushes the external coupling ring 6*b* into the latching position, wherein the blocking tabs 23 are received, not only by the slot 22 on the outer circumferential face of the internal coupling ring 6*a*, but also by the slot 25 on the outer circumferential face of the plug housing 5. With the aid of a colored marker ring 28 which is provided on the outer circumferential face of the internal coupling ring 6*a*, the user can see whether the external coupling ring 6*b* is in the release or in the latching position. The marker ring 28 is visible in the release position, but, in the latching position, it is obscured by the external coupling ring 6*b*. Furthermore, the entire plug element 2 is, in this way, brought around the rotational axis 4 into a defined position relative to the socket element 3, in which position the guide lugs 7 are aligned with the starting areas 18 of the guide grooves 12.

It can also be very readily seen from FIG. 6 that electrical contact elements 29 (contact pins or contact sockets) grouped into several fields are arranged in the interior of the plug housing 5, and that, also disposed in several fields, sealing or insulating inserts 30 with openings for the contact elements 29 are arranged in the interior of the socket housing 11. For the sake of clarity, neither these contact elements nor the sealing or insulating inserts are shown in FIGS. 1 through 5, but are nevertheless present.

Figure 7:
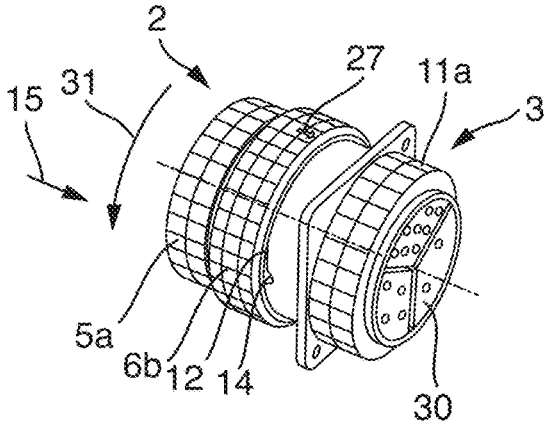

FIG. 7 shows that the plug element 2 is positioned on the socket element 3 in the insertion direction 15. The external coupling ring 6*b* is moved further in the insertion direction 15 and thus shifted longitudinally out of the release position and into the latching position (the marker ring 28 is no longer visible). Here, the blocking tabs 23 leave the slot 25 on the outer circumferential face of the plug housing 5 and are only still accommodated in the slot 22 on the outer circumferential face of the internal coupling ring 6*a*. The latching of the external coupling ring 6*b* is now undone, and it is ready for a rotation around the longitudinal axis 4 in a direction of rotation 31.

Figure 8:
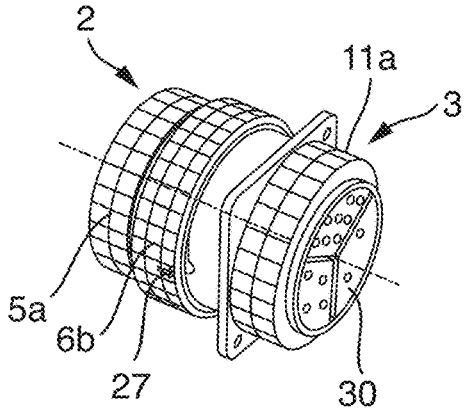

FIG. 8 shows that the external coupling ring 6*b* has carried out the rotation in direction 31. Here, the guide lugs 7 have slid along the oblique ramps 13 of the guide grooves 12, wherein the plug element 2 has been pulled onto the socket element 3. This can be seen from the fact that the distance between the plug element 2 and the socket element 3 is now shorter than in FIG. 7. The completed rotation is shown by the position of the arrow 27, which has rotated by about 90°. At the end of the rotation, the guide lugs 7 enter the end positions 14 and are held there. This is accompanied by an audible click. The plug element 2 and the socket element 3 are now fully coupled together through the bayonet-like connection.

Figure 9:
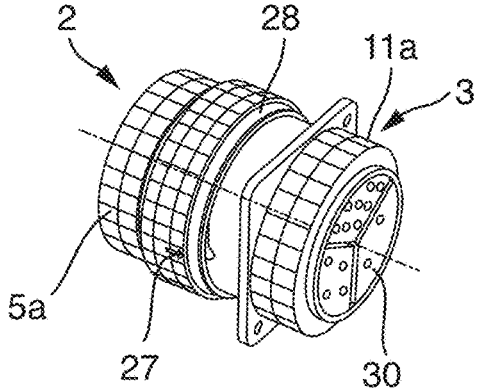

FIG. 9 shows that, once the end position of the external coupling ring 6*b* has been reached, it is then moved automatically into its latching position by the spring element 8. This is indicated by the fact that the marker ring 28 is now visible again. Here, the blocking tabs 23 are now accommodated, not only in the slot 22 on the outer circumferential face of the internal coupling ring 6*a*, but also in the slot 24 on the outer circumferential face of the plug housing 5. The connector 1 is now additionally secured in the fully coupled state, whereby a rotation of the external coupling ring 6*b*, and thus of the entire coupling ring arrangement 6, is prevented.

The invention claimed is:

1. An electrical connector comprising:

a plug element with a longitudinal axis, said plug element having a plug housing with a circular cross-section and a coupling ring arrangement mounted rotatably about the longitudinal axis, wherein at least one guide lug which projects radially inward is arranged on an inner circumferential face of the coupling ring arrangement; and a socket element with a longitudinal axis, said socket element having a socket housing with a circular cross-section configured to accommodate the plug housing, wherein at least one spiral-shaped guide groove configured to receive the at least one guide lug of the coupling ring arrangement is disposed on an outer circumferential face of the socket housing, and wherein an end position for the at least one guide lug of the coupling ring arrangement is disposed at an end of the at least one guide groove, wherein the coupling ring arrangement comprises:

an internal coupling ring which is mounted to the plug housing and configured such that it can be rotated about the longitudinal axis of the plug element and is substantially fixed in a direction of the longitudinal axis of the plug element, and wherein the internal coupling ring comprises the at least one guide lug disposed on the inner circumferential face, an external coupling ring which is mounted to the internal coupling ring, wherein the external coupling ring is configured such that it is substantially fixed from being rotated about the longitudinal axis of the plug element, and can be moved along its longitudinal axis between a release position and a latching position, the coupling ring arrangement configured such that:

in the release position, the coupling ring arrangement is rotatable relative to the plug housing about the longitudinal axis of the plug housing, in the latching position, rotation of the coupling ring arrangement relative to the plug housing is blocked, and the external coupling ring is movable into the latching position at least when the at least one guide lug is in the end position.

2. The electrical connector according to claim 1, wherein the electrical connector has an anti-rotation pin or slot configured to permit an insertion of the plug housing into the socket housing in an insertion direction which runs parallel to the longitudinal axis of the plug element and the socket element, and wherein the anti-rotation pin or slot is configured to prevent a rotation of the plug housing relative to the socket housing around the longitudinal axes.

3. The electrical connector according to claim 1, further comprising a spring element positioned between the internal coupling ring and the external coupling ring wherein the spring element is configured to press the external coupling ring into the latching position.

4. The electrical connector according to claim 1, wherein a direction of movement of the external coupling ring out of the release position into the latching position is opposite to an insertion direction of the plug housing into the socket housing.

5. The electrical connector according to claim 1, wherein the at least one guide groove extends over less than 120° of a circumference on the outer circumferential face of the socket housing.

6. The electrical connector according to claim 1, wherein the connector has at least two spiral guide grooves on the outer circumferential face of the socket housing, and wherein the inner circumferential face of the internal coupling ring comprises a corresponding number of guide lugs.

7. The electrical connector according to claim 1, wherein the end position for the at least one guide lug has a recess directed towards a distal end of the socket housing, wherein the recess is on an end area of the at least one guide groove.

8. The electrical connector according to claim 1, wherein an outer circumferential face of the internal coupling ring and an inner circumferential face of the external coupling ring further comprise a guidance tab or slot, wherein the guidance tab or slot of the internal coupling ring and the guidance tab or slot of the external coupling ring correspond to each other and are connected operatively to each other such that the external coupling ring cannot rotate on the internal coupling ring but can move between the release position and the latching position in the direction of the longitudinal axis of the plug element.

9. The electrical connector according to claim 8, wherein the guidance tab or slot comprise, at least one slot extending in the direction of the longitudinal axis of at least one of the plug element or the socket housing, and at least one blocking tab is configured to be moved back and forth in the at least one slot.

10. The electrical connector according to claim 8, further comprising:

a first guidance tab or slot on an outer circumferential face of the plug housing which corresponds to the guidance tab or slot of the internal coupling ring, wherein the first guidance tab or slot on the outer circumferential face of the plug housing is positioned such that, when the plug element is introduced into the socket element, the external coupling ring is rotated such that the at least one guide lug is located in the end position, wherein the first guidance tab or slot on the outer circumferential face of the plug housing is configured to align with the guidance tab or slot of the internal coupling ring and the external coupling ring is configured to reach the latching position, and wherein the guidance tab or slot of the external coupling ring engages with both the guidance tab or slot of the internal coupling ring and the guidance tab or slot on the outer circumferential face of the plug housing to prevent rotation of the coupling ring arrangement relative to the plug housing.

11. The electrical connector according to claim 10, further comprising:

a second guidance tab or slot on the outer circumferential face of the plug housing which corresponds to the guidance tab or slot of the internal coupling ring, wherein the second guidance tab or slot on the outer circumferential face of the plug housing is circumferentially positioned such that, when the plug element is inserted in the socket element and the external coupling ring has not yet been rotated, the second guidance tab or slot on the outer circumferential face of the plug housing aligns with the guidance tab or slot of the internal coupling ring and the external coupling ring reaches the latching position, and wherein the guidance tab or slot of the external coupling ring engages with both the guidance tab or slot of the internal coupling ring and the guidance tab or slot on the outer circumferential face of the plug housing to prevent rotation of the coupling ring arrangement relative to the plug housing.

12. The electrical connector according to claim 2, wherein the anti-rotation pin or slot have a securing slot in the plug housing extending in the direction of the longitudinal axis of the plug element and a corresponding securing pin provided on an inner circumferential face of the socket housing, wherein the securing pin enters the securing slot when the plug housing is inserted in the socket housing and prevents the plug housing and the socket housing from rotating about the longitudinal axes of the plug element and socket element, and wherein the securing pin is configured to secure movement in the insertion direction.

* * * * *